US011305572B2

(12) United States Patent
Craig et al.

(10) Patent No.: US 11,305,572 B2
(45) Date of Patent: Apr. 19, 2022

(54) METHOD AND SYSTEM FOR INDIRECT MEASUREMENT OF FOUNTAIN SOLUTION USING VARIABLE LASER POWER

(71) Applicant: Xerox Corporation, Norwalk, CT (US)

(72) Inventors: David C. Craig, Pittsford, NY (US); Mark J. Hirsch, Fairport, NY (US); Mark C. Petropoulos, Ontario, NY (US); Eliud Robles Flores, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/917,044

(22) Filed: Jun. 30, 2020

(65) Prior Publication Data

US 2021/0402821 A1 Dec. 30, 2021

(51) Int. Cl.

| | |
|---|---|
| ***B41N 3/08*** | (2006.01) |
| ***B41F 33/00*** | (2006.01) |
| ***B41F 7/24*** | (2006.01) |

(52) U.S. Cl.

CPC ..... *B41N 3/08* (2013.01); *B41F 7/24* (2013.01); *B41F 33/0054* (2013.01); *B41F 33/0063* (2013.01); *B41P 2233/30* (2013.01)

(58) Field of Classification Search

CPC ..... B41N 3/08; B41F 33/0063; B41F 7/24; B41F 33/0054; B41P 2233/30; B41P 2227/20

See application file for complete search history.

(56) References Cited

U.S. PATENT DOCUMENTS

| | | | | |
|---|---|---|---|---|
| 5,826,507 | A | 10/1998 | Lim | |
| 6,832,550 | B2 | 12/2004 | Martin et al. | |
| 7,492,485 | B2 | 2/2009 | Ramesh et al. | |
| 8,575,551 | B2 | 11/2013 | Dotzel | |
| 2011/0081945 | A1* | 4/2011 | Rothaar | H04N 9/3129 455/556.1 |
| 2012/0103212 | A1 | 5/2012 | Stowe et al. | |
| 2012/0103221 | A1 | 5/2012 | Stowe et al. | |
| 2013/0186290 | A1* | 7/2013 | Paul | B41F 31/05 101/348 |
| 2018/0147658 | A1* | 5/2018 | Shapiro | B23K 26/04 |
| 2019/0240971 | A1* | 8/2019 | Gamm | B41F 33/0072 |

OTHER PUBLICATIONS

Co-Pending U.S. Appl. No. 16/916,907, filed Jun. 30, 2020.
Co-Pending U.S. Appl. No. 16/913,302, filed Jun. 26, 2020.
Co-Pending U.S. Appl. No. 16/913,351, filed Jun. 26, 2020.
Co-Pending U.S. Appl. No. 16/913,626, filed Jun. 26, 2020.

* cited by examiner

*Primary Examiner* — Leslie J Evanisko
*Assistant Examiner* — Leo T Hinze
(74) *Attorney, Agent, or Firm* — Caesar Rivise, PC

(57) ABSTRACT

According to aspects of the embodiments, there is provided a method of determining the amount of fountain solution employed in a digital offset lithography printing system. Fountain solution thickness is determined by examining optical density of some halftone or solid patch versus laser current level. The apparatus and method uses a variable current signal to dither or perturb the laser imaging system to irradiate a fountain solution layer to create patches at different laser current levels. An aptly programmed controller then process optical density measurements to indirectly estimate fountain solution level.

19 Claims, 10 Drawing Sheets

METHOD AND SYSTEM FOR INDIRECT MEASUREMENT OF FOUNTAIN SOLUTION USING VARIABLE LASER POWER

FIELD OF DISCLOSURE

This invention relates generally to digital printing systems, and more particularly, to fountain solution deposition systems and methods that determine the level of fountain solution to use in lithographic offset printing systems.

BACKGROUND

Conventional lithographic printing techniques cannot accommodate true high speed variable data printing processes in which images to be printed change from impression to impression, for example, as enabled by digital printing systems. The lithography process is often relied upon, however, because it provides very high quality printing due to the quality and color gamut of the inks used. Lithographic inks are also less expensive than other inks, toners, and many other types of printing or marking materials.

Ink-based digital printing uses a variable data lithography printing system, or digital offset printing system, or a digital advanced lithography imaging system. A "variable data lithography system" is a system that is configured for lithographic printing using lithographic inks and based on digital image data, which may be variable from one image to the next. "Variable data lithography printing," or "digital ink-based printing," or "digital offset printing," or digital advanced lithography imaging is lithographic printing of variable image data for producing images on a substrate that are changeable with each subsequent rendering of an image on the substrate in an image forming process.

For example, a digital offset printing process may include transferring ink onto a portion of an imaging member (e.g., fluorosilicone-containing imaging member, imaging blanket, printing plate) that has been selectively coated with a fountain solution (e.g., dampening fluid) layer according to variable image data. According to a lithographic technique, referred to as variable data lithography, a non-patterned reimageable surface of the imaging member is initially uniformly coated with the fountain solution layer. An imaging system then evaporates regions of the fountain solution layer in an image area by exposure to a focused radiation source (e.g., a laser light source, high power laser) to form pockets. A temporary pattern latent image in the fountain solution is thereby formed on the surface of the digital offset imaging member. The latent image corresponds to a pattern of the applied fountain solution that is left over after evaporation. Ink applied thereover is retained in the pockets where the laser has vaporized the fountain solution. Conversely, ink is rejected by the plate regions where fountain solution remains. The inked surface is then brought into contact with a substrate at a transfer nip and the ink transfers from the pockets in the fountain solution layer to the substrate. The fountain solution may then be removed, a new uniform layer of fountain solution applied to the printing plate, and the process repeated.

Digital printing is generally understood to refer to systems and methods of variable data lithography, in which images may be varied among consecutively printed images or pages. "Variable data lithography printing," or "ink-based digital printing," or "digital offset printing" are terms generally referring to printing of variable image data for producing images on a plurality of image receiving media substrates, the images being changeable with each subsequent rendering of an image on an image receiving media substrate in an image forming process. "Variable data lithographic printing" includes offset printing of ink images generally using specially-formulated lithographic inks, the images being based on digital image data that may vary from image to image, such as, for example, between cycles of an imaging member having a reimageable surface. Examples are disclosed in U.S. Patent Application Publication No. 2012/0103212 A1 (the '212 Publication) published May 3, 2012 based on U.S. patent application Ser. No. 13/095,714, and U.S. Patent Application Publication No. 2012/0103221 A1 (the '221 Publication) also published May 3, 2012 based on U.S. patent application Ser. No. 13/095,778.

The amount or thickness of the fountain layer which is present on the printing plate is a critical part of digital offset printing methods in order to maintain sharp and clear images. The layer is extremely thin, on the order of tens of nanometers, which makes any direct measurement of its thickness difficult. Knowledge of the layer thickness is helpful to control the system image quality. For example, if insufficient fountain solution is provided to a non-image area, the ink will invade the non-image area to create a distorted printing image. Conversely, if too much fountain solution is provided so that the fountain solution enters the image area, a distortion of the image will also result.

The amount of fountain solution which is applied to the printing plates is therefore critical to the production of clear printed images. Currently, the amount of fountain solution which is applied to the plates used in offset lithography is based principally on the experience of the offset press operator. There is to date no accurate method of quantifying the amount of fountain solution used in offset lithography printing processes so as to minimize the undesirable effects of too much or too little fountain solution.

It would therefore be a significant advance in the art of digital offset printing if the amount of fountain solution which is used in the marking process could be quantified without disrupting the operation of the printing process.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a method for "coarsely" measuring fountain solution level and, by measuring and using fountain solution flow rate as an actuator, for controlling fountain solution level. The fountain solution is on the order of nanometers and is therefore extremely difficult to measure. This approach takes advantage of optical density measurements to indirectly estimate fountain solution level by examining optical density of some halftone or solid patch versus laser current level.

According to aspects illustrated herein, an exemplary method to method to determine fountain solution level at an imaging surface in a variable data lithography system by:

applying a layer of fountain solution to the imaging surface; selectively removing with a patterning subsystem portions of the fountain solution layer so as to produce a latent image thereon; dithering a current drive output to the patterning subsystem to selectively remove portions of the fountain solution layer at varying current levels; analyzing the remove portions of the fountain solution layer to acquire optical density of halftone or solid patches at the varying current levels; identifying from the acquired optical density a maximum optical sensitivity to current variation (dL/dAmps); identifying from the acquired optical density a minimum current value (KneeCurrent) at which a solid patch is below a threshold value; determining fountain solution level from the maximum optical sensitivity and the minimum current value; and adjusting the layer of fountain solution based on the determined fountain solution level.

According to aspects described herein, an apparatus useful in a printing device comprising: a dither circuit coupled to a laser imaging system, said dither circuit operable to generate a variable current signal to perturb the laser imaging system to irradiate a fountain solution layer; spectrometer incorporated in the printing device providing a feedback signal of acquired optical density of halftone or solid patches created by the laser imaging system at each variable current signal; and a processor coupled to the dither circuit being operational to receive and process the feedback signal to adjust a layer of fountain solution based on a determined fountain solution level.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION

Figure 1:
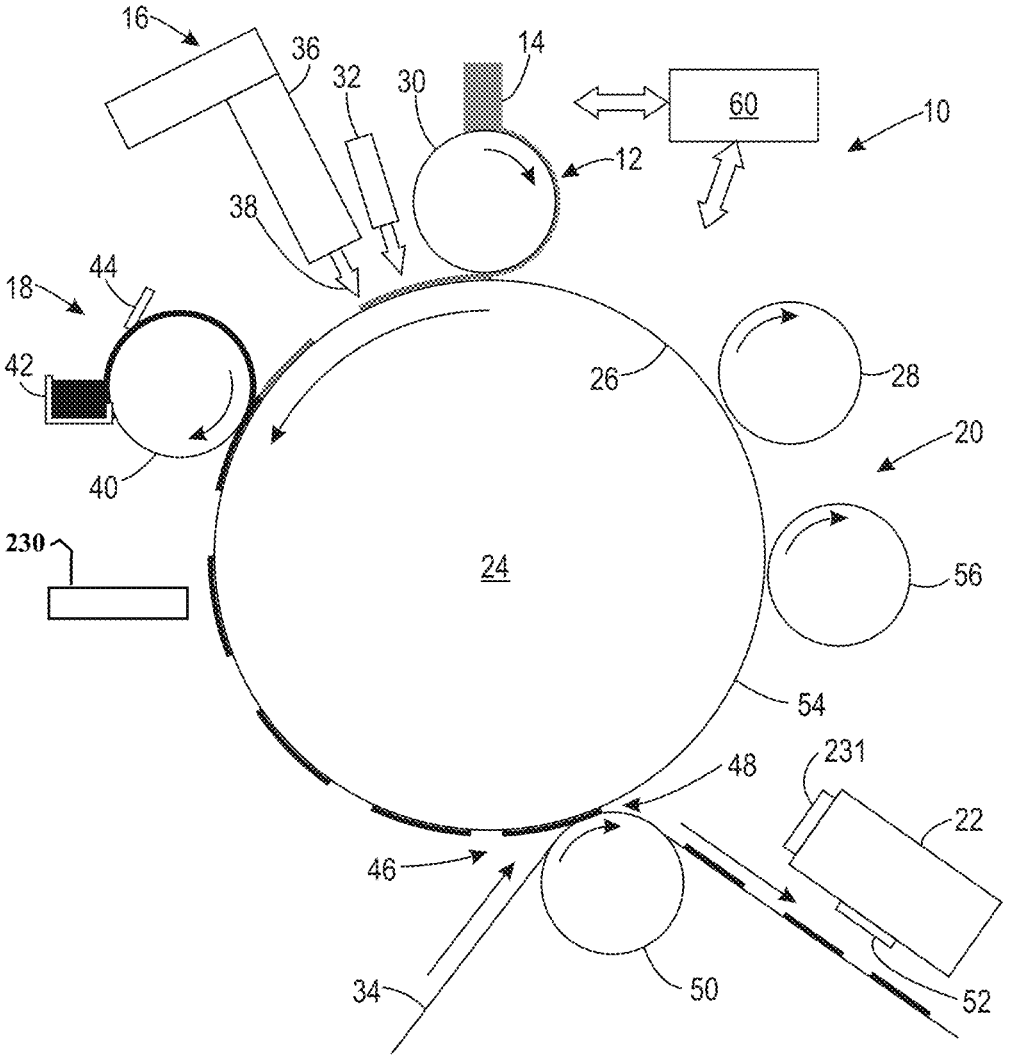
FIG. 1 is block diagram of a digital image forming device in accordance with examples of the embodiments.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. The drawings depict various examples related to embodiments of illustrative methods, apparatus, and systems for inking from an inking member to the reimageable surface of a digital imaging member.

When referring to any numerical range of values herein, such ranges are understood to include each and every number and/or fraction between the stated range minimum and maximum. For example, a range of 0.5-6% would expressly include the endpoints 0.5% and 6%, plus all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The term "controller" is used herein generally to describe various apparatus such as a computing device relating to the operation of one or more device that directs or regulates a process or machine. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

The terms "media", "print media", "print substrate" and "print sheet" generally refers to a usually flexible physical sheet of paper, polymer, Mylar material, plastic, or other suitable physical print media substrate, sheets, webs, etc., for images, whether precut or web fed. The listed terms "media", "print media", "print substrate" and "print sheet" may also include woven fabrics, non-woven fabrics, metal films, and foils, as readily understood by a skilled artisan.

The term "image forming device", "printing device" or "printing system" as used herein may refer to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

The term "fountain solution" or "dampening fluid" refers to dampening fluid that may coat or cover a surface of a structure (e.g., imaging member, transfer roll) of an image forming device to affect connection of a marking material (e.g., ink, toner, pigmented or dyed particles or fluid) to the surface. The fountain solution may include water optionally with small amounts of additives (e.g., isopropyl alcohol, ethanol) added to reduce surface tension as well as to lower evaporation energy necessary to support subsequent laser patterning. Low surface energy solvents, for example volatile silicone oils, can also serve as fountain solutions. Fountain solutions may also include wetting surfactants, such as silicone glycol copolymers. The fountain solution may include D4 or D5 dampening fluid alone, mixed, and/or with wetting agents. The fountain solution may also include Isopar G, Isopar H, Dowsil OS20, Dowsil OS30, and mixtures thereof.

Inking systems or devices may be incorporated into a digital offset image forming device architecture so that the inking system is arranged about a central imaging plate, also referred to as an imaging member. In such a system, the imaging member, including a central drum or cylinder is provided with a reimageable layer. This blanket layer has specific properties such as composition, surface profile, and so on so as to be well suited for receipt and carrying a layer of a fountain solution. A surface of the imaging member is reimageable making the imaging member a digital imaging member. The surface is constructed of elastomeric materials and conformable. A paper path architecture may be situated adjacent the imaging member to form a media transfer nip.

A layer of fountain solution may be applied to the surface of the imaging member by a dampening system. In a digital evaporation step, particular portions of the fountain solution layer applied to the surface of the imaging member may be evaporated by a digital evaporation system. For example, portions of the fountain solution layer may be vaporized by an optical patterning subsystem such as a scanned, modulated laser that patterns the fluid solution layer to form a latent image. In a vapor removal step, the vaporized fountain solution may be collected by a vapor removal device or vacuum to prevent condensation of the vaporized fountain solution back onto the imaging plate.

In an inking step, ink may be transferred from an inking system to the surface of the imaging member such that the ink selectively resides in evaporated voids formed by the patterning subsystem in the fountain solution layer to form an inked image. In an image transfer step, the inked image is then transferred to a print substrate such as paper via pressure at the media transfer nip.

In a variable lithographic printing process, previously imaged ink must be removed from the imaging member surface to prevent ghosting. After an image transfer step, the surface of the imaging member may be cleaned by a cleaning system so that the printing process may be repeated. For example, tacky cleaning rollers may be used to remove residual ink and fountain solution from the surface of the imaging member.

FIG. 1 depicts an exemplary ink-based digital image forming device 10. The image forming device 10 may include dampening station 12 having fountain solution applicator 14, optical patterning subsystem 16, inking apparatus 18, and a cleaning device 20. The image forming device 10 may also include one or more rheological conditioning subsystems 22 as discussed, for example, in greater detail below. FIG. 1 shows the fountain solution applicator 14 arranged with a digital imaging member 24 having a reimageable surface 26. While FIG. 1 shows components that are formed as rollers, other suitable forms and shapes may be implemented.

The imaging member surface 26 may be wear resistant and flexible. The surface 26 may be reimageable and conformable, having an elasticity and durometer, and sufficient flexibility for coating ink over a variety of different media types having different levels of roughness. A thickness of the reimageable surface layer may be, for example, about 0.5 millimeters to about 4 millimeters. The surface 26 should have a weak adhesion force to ink, yet good oleophilic wetting properties with the ink for promoting uniform inking of the reimageable surface and subsequent transfer lift of the ink onto a print substrate.

The soft, conformable surface 26 of the imaging member 24 may include, for example, hydrophobic polymers such as silicones, partially or fully fluorinated fluorosilicones and FKM fluoroelastomers. Other materials may be employed, including blends of polyurethanes, fluorocarbons, polymer catalysts, platinum catalyst, hydrosilyation catalyst, etc. The surface may be configured to conform to a print substrate on which an ink image is printed. To provide effective wetting of fountain solutions such as water-based dampening fluid, the silicone surface need not be hydrophilic, but may be hydrophobic. Wetting surfactants, such as silicone glycol copolymers, may be added to the fountain solution to allow the fountain solution to wet the reimageable surface 26. The imaging member 24 may include conformable reimageable surface 26 of a blanket or belt wrapped around a roll or drum. The imaging member surface 26 may be temperature controlled to aid in a printing operation. For example, the imaging member 24 may be cooled internally (e.g., with chilled fluid) or externally (e.g., via a blanket chiller roll 28 to a temperature (e.g., about 10° C.-60° C.) that may aid in the image forming, transfer and cleaning operations of image forming device 10.

The reimageable surface 26 or any of the underlying layers of the reimageable belt/blanket may incorporate a radiation sensitive filler material that can absorb laser energy or other highly directed energy in an efficient manner. Examples of suitable radiation sensitive materials are, for example, microscopic (e.g., average particle size less than 10 micrometers) to nanometer sized (e.g., average particle size less than 1000 nanometers) carbon black particles, carbon black in the form of nano particles of, single or multi-wall nanotubes, graphene, iron oxide nano particles, nickel plated nano particles, etc., added to the polymer in at least the near-surface region. It is also possible that no filler material is needed if the wavelength of a laser is chosen so to match an absorption peak of the molecules contained within the fountain solution or the molecular chemistry of the outer surface layer. As an example, a 2.94 μm wavelength laser would be readily absorbed due to the intrinsic absorption peak of water molecules at this wavelength.

The fountain solution applicator 14 may be configured to deposit a layer of fountain solution onto the imaging member surface 26 directly or via an intermediate member (e.g., roller 30) of the dampening station 12. While not being limited to particular configuration, the fountain solution applicator 14 may include a series of rollers or sprays (not shown) for uniformly wetting the reimageable surface 26 with a uniform layer of fountain solution with the thickness of the layer being controlled. The series of rollers may be considered as dampening rollers or a dampening unit, for uniformly wetting the reimageable surface 26 with a layer of fountain solution. The fountain solution may be applied by fluid or vapor deposition to create a thin layer (e.g., between about 0.01 μm and about 1.0 μm in thickness, less than 5 μm, about 50 nm to 100 nm) of the fountain solution for uniform wetting and pinning.

A sensor 32, for example an in-situ non-contact laser gloss sensor or laser contrast sensor, may be used to confirm the uniformity of the layer. Such a sensor can be used to automate the dampening station 12. While not being limited to a particular utility, the sensor 32 may provide feedback to control the deposition of the fountain solution onto reimageable surface 26.

The optical patterning subsystem 16 is located downstream the fountain solution applicator 14 in the printing processing direction to selectively pattern a latent image in the layer of fountain solution by image-wise patterning using, for example, laser energy. For example, the fountain solution layer is exposed to an energy source (e.g. a laser) that selectively applies energy to portions of the layer to image-wise evaporate the fountain solution and create a latent "negative" of the ink image that is desired to be printed on a receiving substrate 34. Image areas are created where ink is desired, and non-image areas are created where the fountain solution remains. While the optical patterning subsystem 16 is shown as including laser emitter 36, it should be understood that a variety of different systems may be used to deliver the optical energy to pattern the fountain solution layer.

Still referring to FIG. 1, a vapor vacuum 38 or air knife may be positioned downstream the optical patterning subsystem to collect vaporized fountain solution and thus avoid leakage of excess fountain solution into the environment. Reclaiming excess vapor prevents fountain solution from depositing uncontrollably prior to the inking apparatus 18 and imaging member 24 interface. The vapor vacuum 38 may also prevent fountain solution vapor from entering the environment. Reclaimed fountain solution vapor can be condensed, filtered and reused as understood by a skilled artisan to help minimize the overall use of fountain solution by the image forming device 10.

Following patterning of the fountain solution layer by the optical patterning subsystem 16, the patterned layer over the reimageable surface 26 is presented to the inking apparatus 18. The inker apparatus 18 is positioned downstream the optical patterning subsystem 16 to apply a uniform layer of ink over the layer of fountain solution and the reimageable surface layer 26 of the imaging member 24. The inking apparatus 18 may deposit the ink to the evaporated pattern representing the imaged portions of the reimageable surface 26, while ink deposited on the unformatted portions of the fountain solution will not adhere based on a hydrophobic and/or oleophobic nature of those portions. The inking apparatus may heat the ink before it is applied to the surface 26 to lower the viscosity of the ink for better spreading into imaged portion pockets of the reimageable surface. For example, one or more rollers 40 of the inking apparatus 18 may be heated, as well understood by a skilled artisan. Inking roller 40 is understood to have a structure for depositing marking material onto the reimageable surface layer 26, and may include an anilox roller or an ink nozzle. Excess ink may be metered from the inking roller 40 back to an ink container 42 of the inker apparatus 18 via a metering member 44 (e.g., doctor blade, air knife).

Although the marking material may be an ink, such as a UV-curable ink, the disclosed embodiments are not intended to be limited to such a construct. The ink may be a UV-curable ink or another ink that hardens when exposed to UV radiation. The ink may be another ink having a cohesive bond that increases, for example, by increasing its viscosity. For example, the ink may be a solvent ink or aqueous ink that thickens when cooled and thins when heated.

Downstream the inking apparatus 18 in the printing process direction resides ink image transfer station 46 that transfers the ink image from the imaging member surface 26 to a print substrate 34. The transfer occurs as the substrate 34 is passed through a transfer nip 48 between the imaging member 24 and an impression roller 50 such that the ink within the imaged portion pockets of the reimageable surface 26 is brought into physical contact with the substrate 34.

Rheological conditioning subsystems 22 may be used to increase the viscosity of the ink at specific locations of the digital offset image forming device 10 as desired. While not being limited to a particular theory, rheological conditioning subsystem 22 may include a curing mechanism 52, such as a UV curing lamp (e.g., standard laser, UV laser, high powered UV LED light source), wavelength tunable photoinitiator, or other UV source, that exposes the ink to an amount of UV light (e.g., # of photons radiation) to at least partially cure the ink/coating to a tacky or solid state. The curing mechanism may include various forms of optical or photo curing, thermal curing, electron beam curing, drying, or chemical curing. In the exemplary image forming device 10 depicted in FIG. 1, rheological conditioning subsystem 22 may be positioned adjacent the substrate 34 downstream the ink image transfer station 46 to cure the ink image transferred to the substrate. Rheological conditioning subsystems 22 may also be positioned adjacent the imaging member surface 26 between the ink image transfer station 46 and cleaning device 20 as a preconditioner to harden any residual ink 54 for easier removal from the imaging member surface 26 that prepares the surface to repeat the digital image forming operation.

This residual ink removal is most preferably undertaken without scraping or wearing the imageable surface of the imaging member. Removal of such remaining fluid residue may be accomplished through use of some form of cleaning device 20 adjacent the surface 26 between the ink image transfer station 46 and the fountain solution applicator 14. Such a cleaning device 20 may include at least a first cleaning member 56 such as a sticky or tacky roller in physical contact with the imaging member surface 26, with the sticky or tacky roller removing residual fluid materials (e.g., ink, fountain solution) from the surface. The sticky or tacky roller may then be brought into contact with a smooth roller (not shown) to which the residual fluids may be transferred from the sticky or tacky member, the fluids being subsequently stripped from the smooth roller by, for example, a doctor blade or other like device and collected as waste. It is understood that the cleaning device 20 is one of numerous types of cleaning devices and that other cleaning devices designed to remove residual ink/fountain solution from the surface of imaging member 24 are considered within the scope of the embodiments. For example, the cleaning device could include at least one roller, brush, web, belt, tacky roller, buffing wheel, etc., as well understood by a skilled artisan.

In the image forming device 10, functions and utility provided by the dampening station 12, optical patterning subsystem 16, inking apparatus 18, cleaning device 20, rheological conditioning subsystems 22, imaging member 24 and sensor 32 may be controlled, at least in part by controller 60. Such a controller 60 is shown in FIG. 1 and may be further designed to receive information and instructions from a workstation or other image input devices (e.g., computers, smart phones, laptops, tablets, kiosk) to coordinate the image formation on the print substrate through the various subsystems such as the dampening station 12, patterning subsystem 16, inking apparatus 18, imaging member 24 and sensor 32 as discussed in greater detail below and understood by a skilled artisan.

Sensor 230 and sensor 231 are densitometer or spectrometer, such as a spectrophotometer, that may be used to measure the printed Halftone on an inked print media such as by sensor 231 or patterned image on reimageable surface 26 by sensor 230. Such measurements may be combined with measurements of a solid inked area and of the bare substrate and converted into a spectral light intensity "L Value", for example, using equations that are well known in the industry.

A signal from sensor 230 or sensor 231 is converted to an optical density value through known logarithmic techniques. The particular advantage of optical density measurement is the fact that the density value has a simple relationship with the fountain solution layer thickness. It is possible for a large number of measured values to be obtained on a measurement field of given size over a short period of time. The optical density measurements are made available to controller 60 and a processor within the controller is able to receive and process the measurements to adjust a layer of fountain solution or current applied to a patterning subsystem.

Identical reference numbers in the Figures refer to identical or analogous elements and descriptions of the same portions as those as in a prior embodiment will be omitted.

Figure 2:
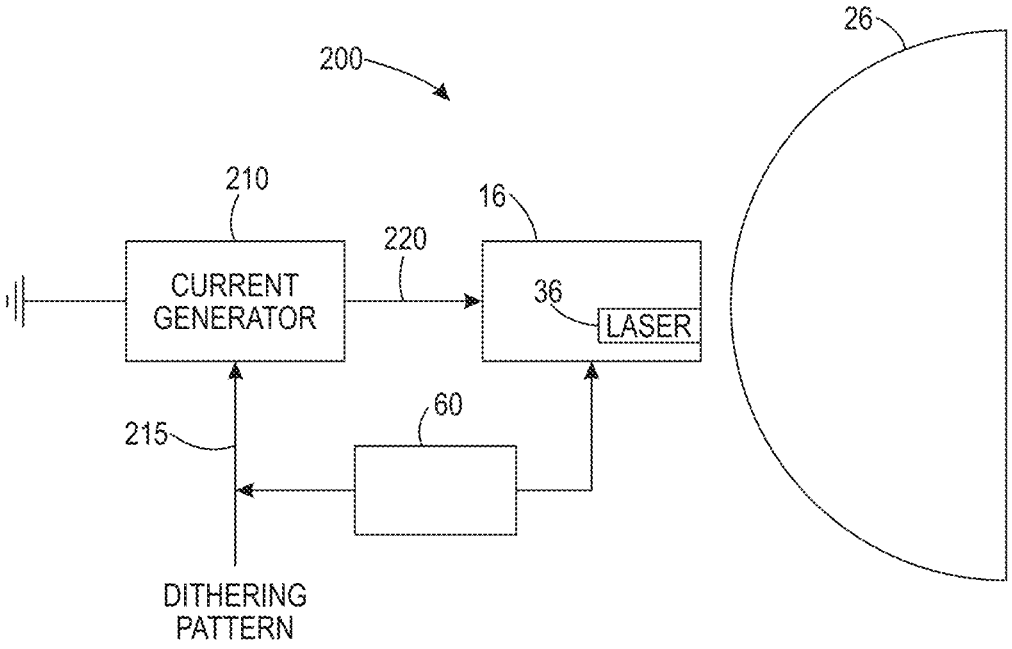
FIG. 2 is part of a digital image forming device that includes a current generator for dithering the applied current to a patterning subsystem in accordance to an embodiment.

FIG. 2 is an apparatus 200 part of a digital image forming device that includes a current generator for dithering the applied current to a patterning subsystem in accordance to an embodiment. Apparatus 200 comprises a current generator 210, a patterning subsystem 16, and controller for operating the generator and subsystem following a sequence of instructions.

The output of the current generator block 210 is a dither current signal 220 that is applied to the patterning subsystem 16. The effect of the operation is to add random noise, i.e., a dither signal 215, at the input of the current generator, where the amplitude of the random noise is controlled in such a manner to cause the current signal 220 to increase or decrease by an amount correlated to the dithering pattern 215 under the command of controller 60. Moreover, in some examples, the magnitude of the dither signal 215 can be set in a range from about −30 A to about +30 Amps. The controller 60 can then dither the generator in a stepwise fashion to apply different current levels to laser 36. In the case of a laser 36 having a current driver set for 90 Amps the current applied (current signal 220) to the laser 36 would range from 60 A to 120 A. The dither current signal 220 perturbs the laser imaging system like laser 36 to irradiate a fountain solution layer at surface 26 at different optical power.

Identical reference numbers in the Figures refer to identical or analogous elements and descriptions of the same portions as those as in a prior embodiment will be omitted such as described in FIGS. 1-2.

Figure 3:
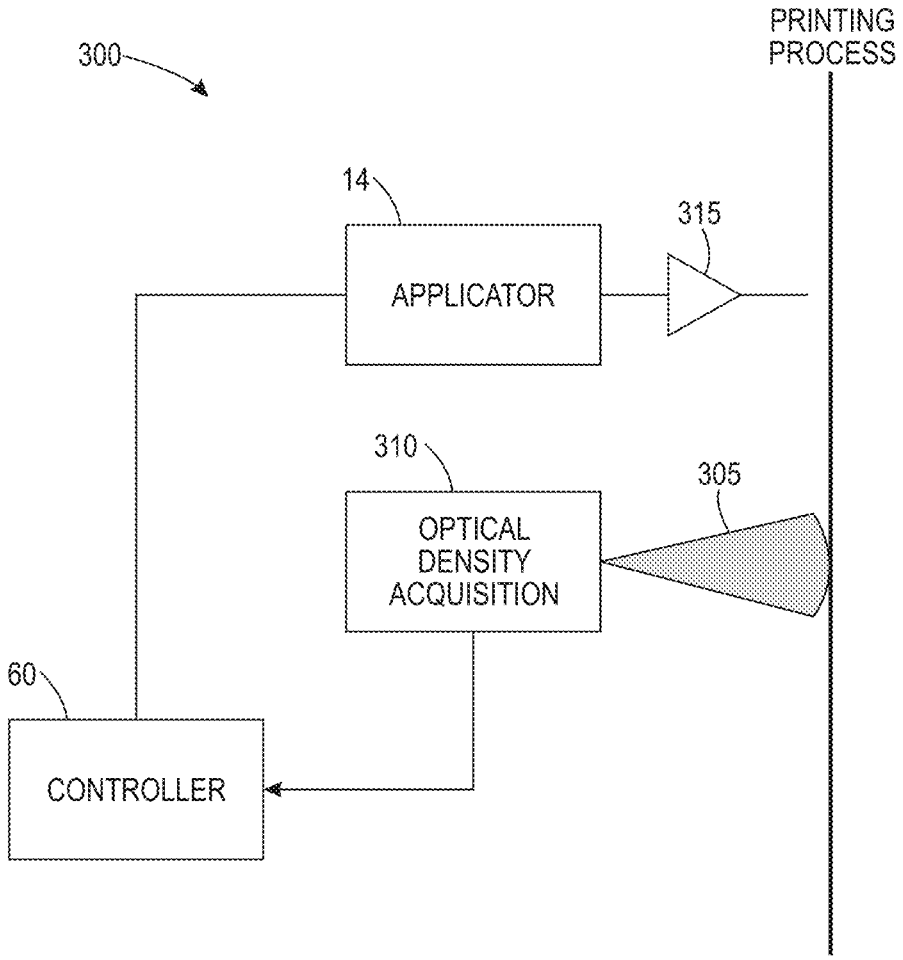
FIG. 3 is part of a digital image forming device that includes a feedback loop for controlling and applicator that dispenses fluid solution in accordance to an embodiment.

FIG. 3 is an apparatus 300 of a digital image forming device that includes a feedback loop for controlling and applicator that dispenses fluid solution in accordance to an embodiment. Apparatus comprises an applicator for dispensing fountain solution through valve actuator 315, an optical density acquisition device 310, and a controller 60. In operation, the optical density acquisition device 310 is sensor 230 or sensor 231, which can be a densitometer or spectrometer, such as a spectrophotometer, that may be used to measure spectral light intensity "L Value" on an inked print media such as by sensor 231 or patterned image on reimageable surface 26 by sensor 230. The acquisition device 310 receives optical density data such as luminance (L*) that is reflected 305 during the printing process from imaging media or the plate 24 of system 10. The acquired image/optical density at sensor 310 is then feedback to controller 60 for processing so as to ascertain a fountain solution level or thickness as the digital lithography system 10 is performing a printing process. Controller 60 produces actionable information such as control values that can be used by the dampening solution subsystem such as fountain solution applicator 14 to increase or decrease the fountain solution applied to digital imaging member 24.

Figure 4:
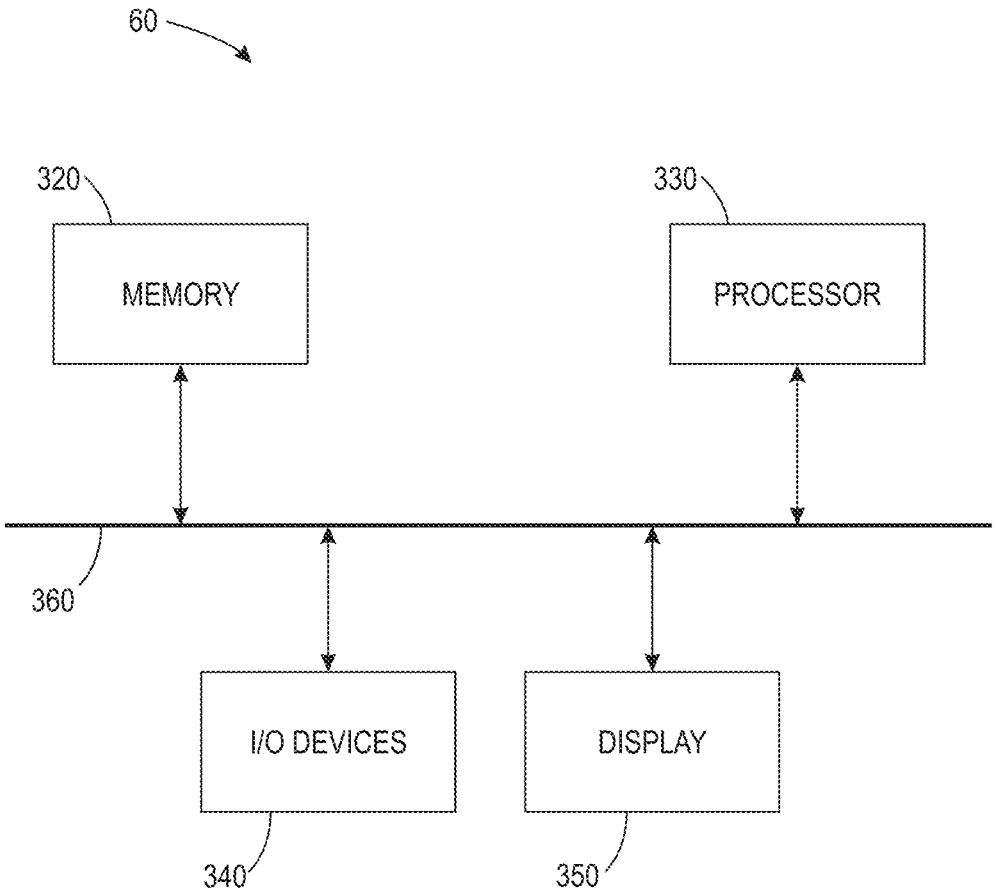
FIG. 4 is a block diagram of a controller with a processor for executing instructions to automatically control devices in the digital image forming device depicted in FIGS. 1-3 in accordance to an embodiment.

FIG. 4 is a block diagram of a controller 60 with a processor for executing instructions to automatically control devices in the digital image forming device depicted in FIGS. 1-3 in accordance to an embodiment.

The controller 60 may be embodied within devices such as a desktop computer, a laptop computer, a handheld computer, an embedded processor, a handheld communication device, or another type of computing device, or the like. The controller 60 may include a memory 320, a processor 330, input/output devices 340, a display 330 and a bus 360. The bus 360 may permit communication and transfer of signals among the components of the computing device 60.

Processor 330 may include at least one conventional processor or microprocessor that interprets and executes instructions. The processor 330 may be a general purpose processor or a special purpose integrated circuit, such as an ASIC, and may include more than one processor section. Additionally, the controller 60 may include a plurality of processors 330.

Memory 320 may be a random access memory (RAM) or another type of dynamic storage device that stores information and instructions for execution by processor 330. Memory 320 may also include a read-only memory (ROM) which may include a conventional ROM device or another type of static storage device that stores static information and instructions for processor 330. The memory 320 may be any memory device that stores data for use by controller 60. Memory 320 maintains a multidimensional lookup table (LUT) of control values such as "xy" and "pq" discussed below with reference to FIG. 5. These LUT values can be used to print a diagnostic print that when captured and analyzed to derive optimized control values for printing.

Input/output devices 340 (I/O devices) may include one or more conventional input mechanisms that permit a user to input information to the controller 60, such as a microphone, touchpad, keypad, keyboard, mouse, pen, stylus, voice recognition device, buttons, and the like, and output mechanisms such as one or more conventional mechanisms that output information to the user, including a display, one or more speakers, a storage medium, such as a memory, magnetic or optical disk, disk drive, a printer device, and the like, and/or interfaces for the above. The display 330 may typically be an LCD or CRT display as used on many conventional computing devices, or any other type of display device.

The controller 60 may perform functions in response to processor 330 by executing sequences of instructions or instruction sets contained in a computer-readable medium, such as, for example, memory 320. Such instructions may be read into memory 320 from another computer-readable medium, such as a storage device, or from a separate device via a communication interface, or may be downloaded from an external source such as the Internet. The controller 60 may be a stand-alone controller, such as a personal computer, or may be connected to a network such as an intranet, the Internet, and the like. Other elements may be included with the controller 60 as needed.

The memory 320 may store instructions that may be executed by the processor to perform various functions. For example, the memory may store instructions to control the application of fountain solution, dithering and controlling the current applied to the laser so as to adjust the optical power for patterning the fountain solution on the digital imaging member 24, and other control functions enumerated herewith.

Figure 5:
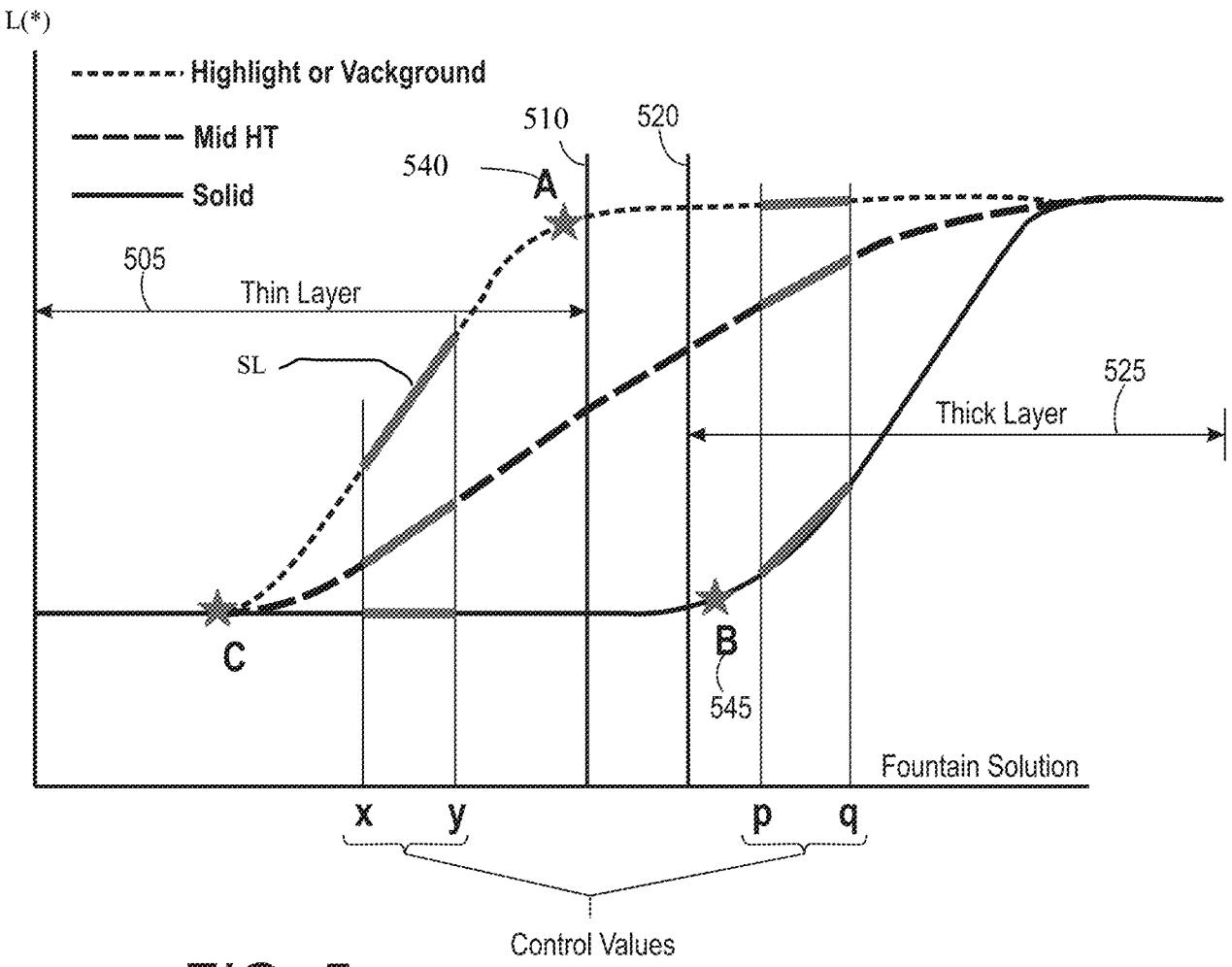
FIG. 5 illustrates the image/optical density as function of fountain solution thickness in accordance to an embodiment.

FIG. 5 illustrates the image/optical density as function of fountain solution thickness in accordance to an embodiment. FIG. 5 plots image density (axis labeled L (*)) and thickness of fountain solution from data acquired from optical density acquisition device 310. The asymptotic behavior for very thin layers 505 is that all fountain solution is evaporated, which allows a full solid area to be deposited, resulting in maximum density (lowest L*). This density is constant for all smaller thicknesses. At the other extreme, very thick fountain solution layers 525 retain sufficient thickness after imaging that no ink is allowed to deposit.

Between these two extremes region between 510 and 520 is where all actual printing will take place. The desired latitude space for fountain solution thickness lies between the two lines (510, 520), which are roughly marked by the starred points A 540 and B 545. In this space there is sufficient fountain solution thickness to avoid background in non-imaged areas yet the layer is thin enough that the laser can fully evaporate all of it to obtain a good solid image.

This embodiment proposes to use information on system performance to decide on the appropriate level of fountain solution to set, i.e., a window of fountain solution control values. For instance, setting the fountain solution control values "x" and "y" allow the sensitivities bolded to be measured. Likewise, varying the fountain solution control knob between values "p" and "q" allow another set of sensitivities to be measured. As shown, control values xy and pq correspond to the slope (SL) of the response curves in the thin layer 505 and thick layer 525. Knowing the general expected shapes of the responses determine the control settings which would give thicknesses corresponding to "A" 540 or "B" 545, which bound the desired latitude window as defined by lines 510 and 520. As can be seen gradually thickening the fountain solution produces a curve that approaches an asymptotic value "A" 540 for the background and "B" 545 for the solid response curves. In some embodiments, methods comprise identifying the asymptotic value A or B of a response by using well known mathematical techniques or by identifying the point where the response curve becomes or ceases being flat like shown in FIG. 5.

The optimum values of "x" and "y" or "p" and "q" would be empirically determined through experience and set by the operator or the system as a set of fountain solution control values when producing at least one diagnostic image. They may or may not include values that would be in the latitude window for optimum printing. They would also likely be dependent on the value of laser power used. The operator would then print the set of diagnostic images, or a single image, using x,y,p, and q control values. After printing the at least one diagnostic image, image density acquired using acquisition device 310 is correlated to fountain solution and a new set of control values are communicated to the operator or enter into an LUT at memory 320.

The described embodiment does not give a fountain solution thickness in absolute length units; it does provide the desired setting (defined by 510 and 520) for the control knob that sets the fountain solution thickness. That is actually the desired setting to know and to control.

In the following description of embodiments (FIGS. 6-8) describe events where lithography noises are well-controlled, such as the temperature of the blanket, then the current applied to subsystem 16 could be increased or decrease following a programmed pattern. From this programmed pattern, then that the amount of fountain solution on the blanket can be roughly determined by examining optical density of some halftone or solid patch versus the laser current level.

Figure 6:
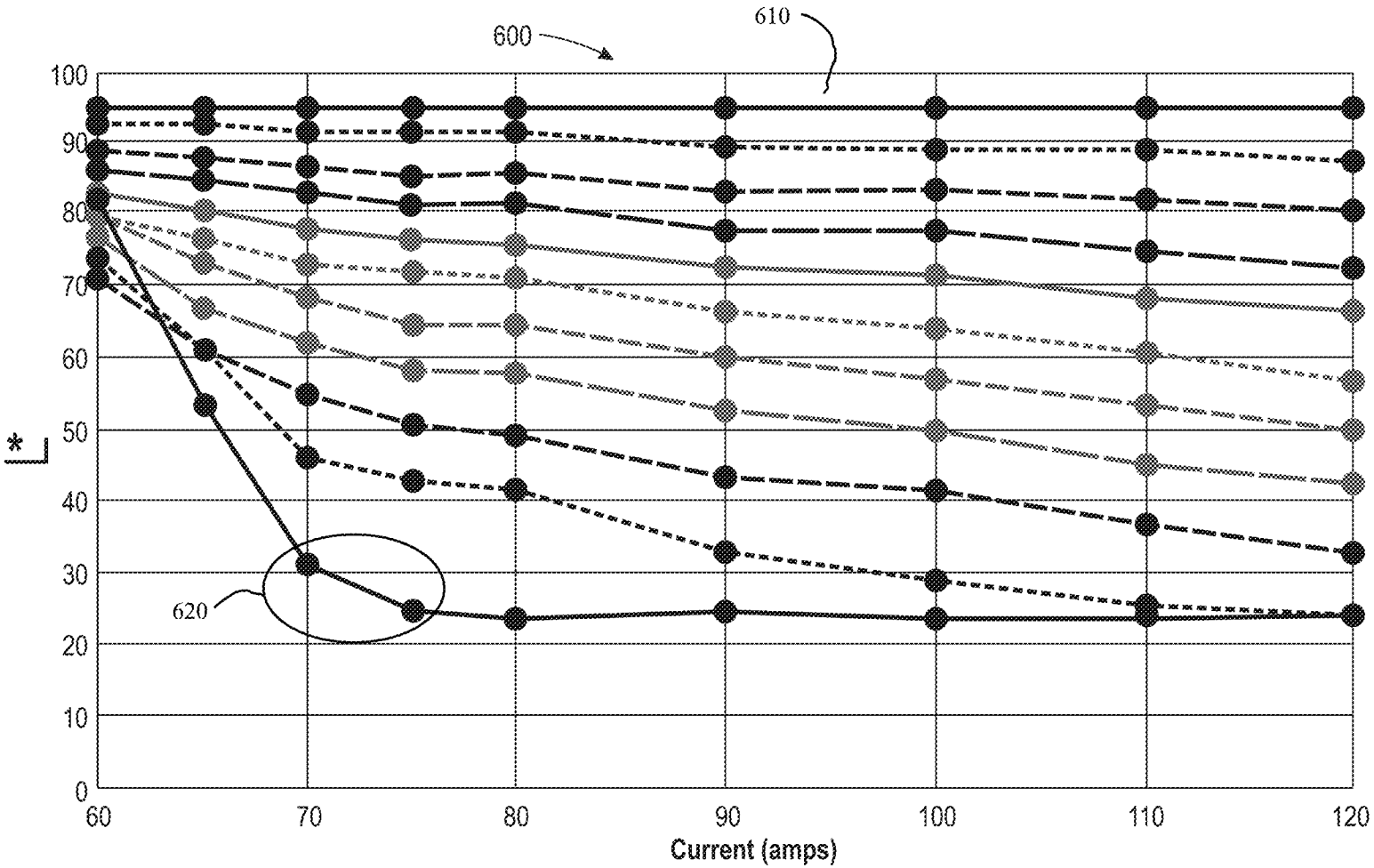
FIG. 6 is a plot of electrical current and optical density in accordance to an embodiment.

FIG. 6 is a plot of electrical current and optical density in accordance to an embodiment. Plot 600, illustrates the relationship between L* (a measure of lightness) of various halftone area coverages versus laser current (measure in Amps). There are two extreme cases for fountain solution thickness and their detection via optical density. If there is no fountain solution on the blanket, then the patches will be dark without any laser current as can be seen from response 610. At the other extreme, if there is a very large amount of fountain solution on the blanket, then, even at a high laser current, the fountain solution will not be adequately evaporated, and the patch densities will be very low (high L*). As can be seen at plot 600 higher thickness fountain solution produces low patch densities. Due to the thickness an increase in current has minor changes since the laser may not be high enough to remove it from the blanket. The lower plots show how a change in laser current changes the patch densities, i.e., change in L is correlated to a change in amps. The point before minimal change in patch density is known as the knee current 610.

The knee current 610 is the value for laser current at which the optical density (L) versus current curve goes flat (the knee of the curve) or as the asymptotic value of the response. This point or asymptotic value essentially represents the inflection point at which the fountain solution has been evaporated; if it occurs at high currents (X++), then fountain solution thickness is large, and if at low currents (X−−) then fountain solution thickness is low. Plot 600 shows the knee current 610 for a response occurring at a low current, assuming 90 Amps is the target value (setpoint) for patterning subsystem 16, which would indicate a low fountain solution.

Figure 7:
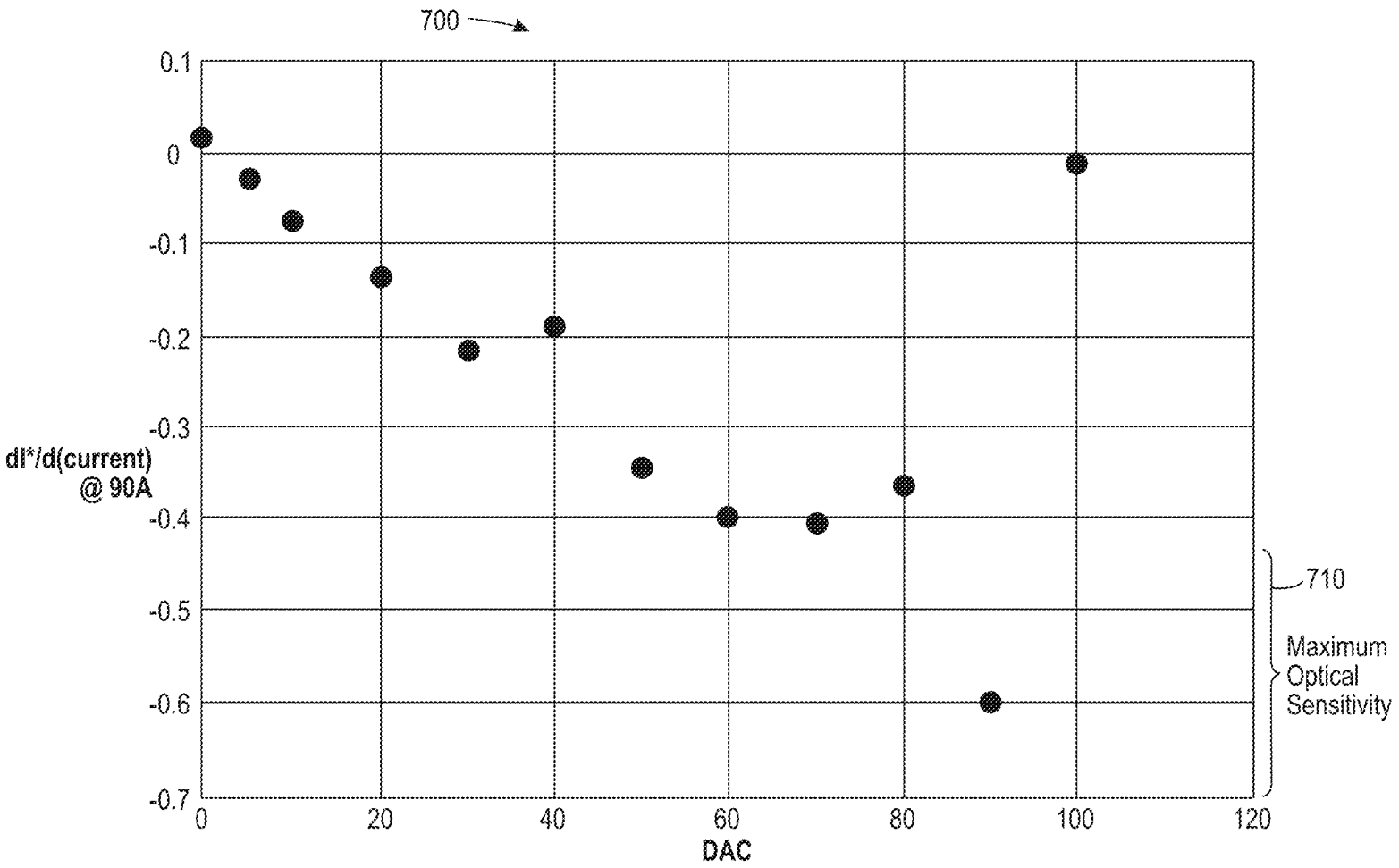
FIG. 7 is a plot of optical sensitivity to current variation and digital area coverage (DAC) in accordance to an embodiment.

FIG. 7 is a plot of optical sensitivity to current variation and digital area coverage (DAC) in accordance to an embodiment.

Plot 700 illustrates the relationship between how a change in current effects observed optical density due to the fountain solution level. Plot 700 is the slope of the curves in FIG. 6. In particular, the slopes of these curves will depend on the level of fountain solution on the blanket 24. To optimize the method for identifying optical density to current variations, a halftone area coverage is selected that yields the maximum optical sensitivity to current variation (at some chosen current value). For example, the graph or plot 700 shows slope (dL*/dAmps) versus digital area coverage (DAC). Continuing with plot 700, one can see that, for X A laser current, the slope of L* versus current is largest at about 85% area coverage.

To determine current sensitivity, the method would therefore dither or vary current around X A, plus and minus, and determine the slope of L* versus current at this point. For low fountain solutions levels, the slope at this point is very small because most if not all of the fountain solution has already evaporated as can be seen at the upper part of plot 700. For high fountain solutions levels, evaporation requires more current, so at the X A setpoint, and 85% DAC, there is still a strong sensitivity (slope) to L* variation versus current which corresponds to the maximum optical sensitivity 710 at plot 700.

Combining the metrics outlined in FIG. 7, i.e., the slope of DAC=85%, with current=X A, slope85@XA, and the metric outlined in FIG. 6, i.e., the minimum current value at which the solid L* slope is less than (<) threshold T (the curve goes approximately flat)—(kneeCurrent), will provide a reasonable prediction of fountain solution level according to the following equation:

$$\text{FountainSolution}=F_0+a(\text{kneeCurrent})+b(\text{slope85@}90A)+c \qquad \text{F1}$$

Where $F_o$ is an initial value for fountain solution that could be based on the opening at actuator valve 315, "a" and "b" are a normalizing coefficients, and "c" is an error coefficient.

Figure 8:
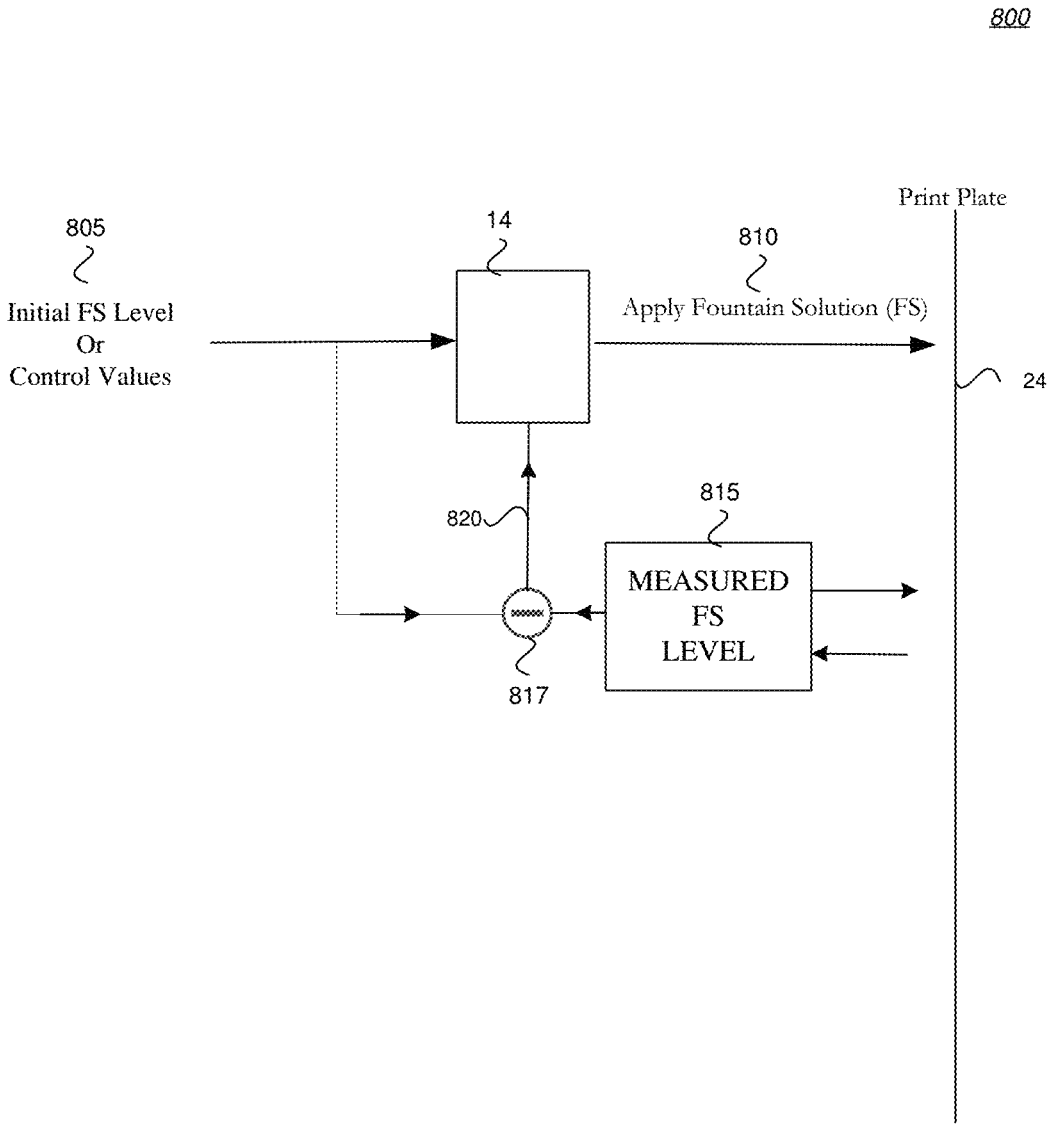
FIG. 8 is a feedback apparatus to control fountain solution thickness in accordance to an embodiment.

FIG. 8 is a feedback apparatus to control fountain solution thickness in accordance to an embodiment.

Applicator 14 receives an initial fountain solution (FS) level 805 or control values which corresponds to a desired fountain solution thickness from an operator or LUT. The applicator is configured to deposit a layer of fountain solution onto the imaging member surface such as plate 24 using fountain solution flow rate as an actuator as outlined in FIG. 3. After an image is formed and inked on the plate or on a print media it is analyzed 815 and with formula F1 the fountain solution level is determined. The fountain level derived at 815 is then subtracted from the initial FS level. When the level is higher than the initial value it sends a signal 820 to the applicator 14 to reduce the initial value 805 by the difference. Likewise when the level is lower, then the feedback signal 820 would increase the initial value by the difference. Using the feedback mechanism and formula F the FS thickness can be maintained at a desired or optimized level.

The disclosed embodiments may include an exemplary method for optimizing and determining fountain solution thickness or level for variable data lithography printing systems. As such, the particular methods of such an embodiment are described by reference to a series of flowcharts. Describing the methods by reference to a flowchart enables one skilled in the art to develop such programs, firmware, or hardware, including such instructions to carry out the methods on suitable computers, executing the instructions from computer-readable media. Similarly, the methods performed by the server computer programs, firmware, or hardware are also composed of computer-executable instructions. Further, Interconnection between the processes, which compose the flowcharts, represents the exchange of information between the processes. Once the flow is modelled, each process may be implemented in a conventional manner. Each process may, for example, be programmed using a higher level language like Java, C++, Python, Perl, or the like, or may be performed using existing applications having a defined interface. Methods 900-1000 are performed by a program executing on, or performed by firmware or hardware that is a part of, a computer, such as controller/computer 60 in FIG. 4

The exemplary depicted sequence of executable method steps represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 9 or FIG. 10, and the accompanying description, except where any particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to disclosure.

Figure 9:
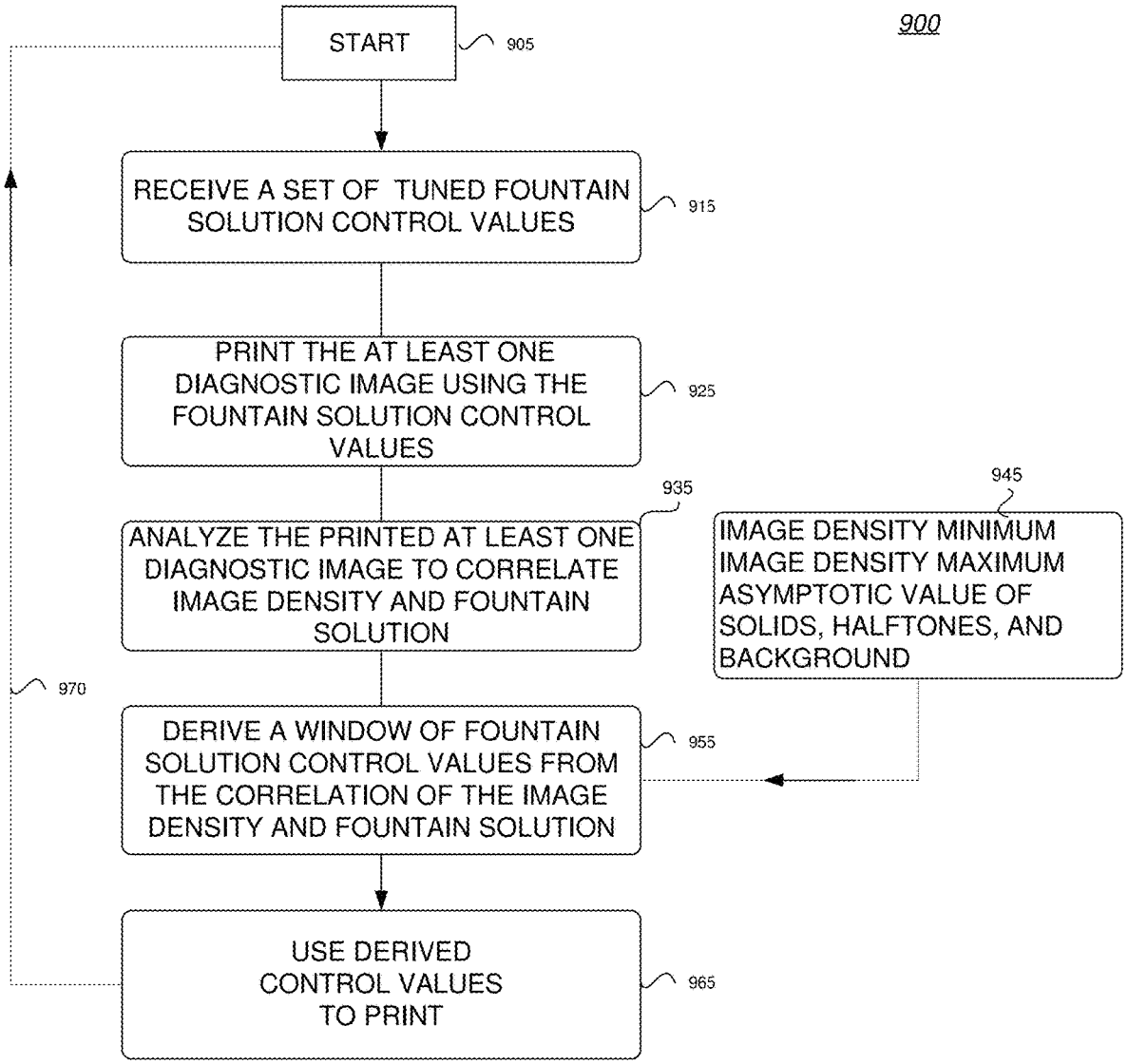
FIG. 9 is a flowchart depicting the operation of an exemplary method configured for use in a digital image forming device for optimizing fountain solution thickness in accordance to an embodiment.

FIG. 9 is a flowchart depicting the operation of an exemplary method configured for use in a digital image forming device for optimizing fountain solution thickness in accordance to an embodiment. Method 900 begins with action 905 where the process is invoked by an operator or the system 10 wishing to know the fountain solution thickness or level. Control is then passed to action 915, in action 915 method 900 receives a set of fountain solution control values from an operator or from a LUT stored in memory 320. The control values are the xy and pq values explained in FIG. 5. Control is then passed to action 925, where at least one diagnostic image is printed using the fountain solution control values received in action 915. Control is then passed to action 935, where method 900 analyzes the printed at least one diagnostic image to correlate image density and fountain solution. From the analyses of action 935, action 945 derives image density minimum, image density maximum, and asymptotic values for responses, shown in FIG. 5, like solids, halftones, and background. Control is passed to action 955 for further processing where method 900 derive a window of fountain solution control values from the correlation of the image density and fountain solution. The fountain solution control values are shown bounded by extreme region 510 and 520. Control is then passed to action 965 where the printer 10 uses the fountain solution control values thereby insuring a print that is optimized for printing either thin and thick layers. Control is passed to action 905 through return 970 to until the triggering of method 900 at start 905.

Figure 10:
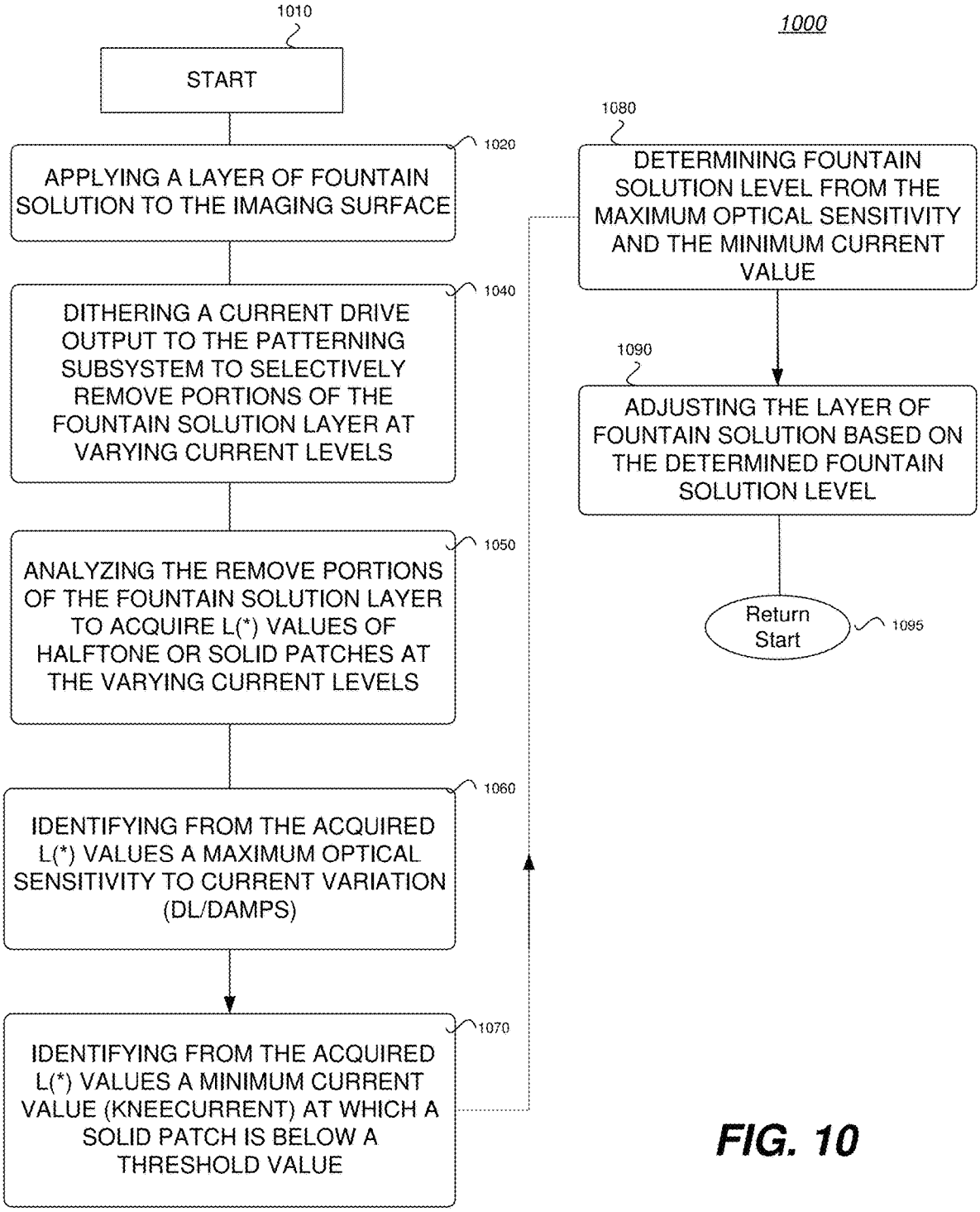
FIG. 10 is a flowchart depicting the operation of an exemplary method configured for use in a digital image forming device for determining fountain solution level in accordance to an embodiment.

FIG. 10 is a flowchart depicting the operation of an exemplary method configured for use in a digital image forming device for determining fountain solution level in accordance to an embodiment. Method 1000 begins with action 1010 where the process is invoked by an operator or the system 10 wishing to know the fountain level or fountain solution thickness. In method 900 the control values (510 and 520 of FIG. 5) are determine while method 1000 the fountain solution level is calculated by changing or dithering the current level power of subsystem 16 or the laser therein. Control is then passed to action 1020; method 1000 applies a layer of fountain solution to the imaging surface like surface 26 of imaging member 24. Control is passed to action 1040 where method 1000 dithers a current drive output to the patterning subsystem to selectively remove portions of the fountain solution layer at varying current levels. In action 1050, method 1000 analyzes the remove portions (action 1040) of the fountain solution layer to acquire optical density like L* of halftone or solid patches at the varying current levels. In action 1060 the method identifies from the acquired optical density a maximum optical sensitivity to current variation (dL/dAmps). In action 1070, method 1000 identifies from the acquired optical density a minimum current value (KneeCurrent) which corresponds to the area where a solid patch is below a threshold value (T). At the KneeCurrent a change in applied current produces minor or zero changes in luminance (L*). In action 1080, the method combines the parameters of action 1060 and 1070 to determine fountain solution level from the maximum optical sensitivity and the minimum current value. In action 1090, the fountain solution level from action 1080, is used to adjust the applied fountain solution layer to either increase or increase the dispensing by the difference. In this way measuring and using fountain solution flow rate can be used as an actuator for maintaining optimal fountain solution layer. In the final action 1095 control is returned to the beginning of the method at action 1010.

The disclosed embodiments may include an exemplary method for optimizing and determining fountain solution thickness or level for variable data lithography printing systems. As such, the particular methods of such an embodiment are described by reference to a series of flowcharts. Describing the methods by reference to a flowchart enables one skilled in the art to develop such programs, firmware, or hardware, including such instructions to carry out the methods on suitable computers, executing the instructions from computer-readable media. Similarly, the methods performed by the server computer programs, firmware, or hardware are also composed of computer-executable instructions. Further, Interconnection between the processes, which compose the flowcharts, represents the exchange of information between the processes. Once the flow is modelled, each process may be implemented in a conventional manner. Each process may, for example, be programmed using a higher level language like Java, C++, Python, Perl, or the like, or may be performed using existing applications having a defined interface. Methods 900-1000 are performed by a program executing on, or performed by firmware or hardware that is a part of, a computer, such as controller/computer 60 in FIG. 4

The exemplary depicted sequence of executable method steps represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 9 or FIG. 10, and the accompanying description, except where any particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to disclosure.

FIG. 9 is a flowchart depicting the operation of an exemplary method configured for use in a digital image forming device for optimizing fountain solution thickness in accordance to an embodiment.

FIG. 10 is a flowchart depicting the operation of an exemplary method configured for use in a digital image forming device for determining fountain solution level in accordance to an embodiment.

Those skilled in the art will appreciate that other embodiments of the disclosed subject matter may be practiced with many types of image forming elements common to offset inking system in many different configurations. For example, although digital lithographic systems and methods are shown in the discussed embodiments, the examples may apply to analog image forming systems and methods, including analog offset inking systems and methods. It should be understood that these are non-limiting examples of the variations that may be undertaken according to the disclosed schemes. In other words, no particular limiting configuration is to be implied from the above description and the accompanying drawings.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A variable data lithography system, comprising:

an imaging member having an arbitrarily reimageable imaging surface;

a dampening solution subsystem for applying a layer of fountain solution to the imaging surface;

a patterning subsystem for selectively removing portions of the fountain solution layer so as to produce a latent image thereon;

a controllable current generator to provide a variable current drive output to the patterning subsystem, whereby output power from the patterning subsystem is adjustable by controlling the current generator to vary the variable current drive output to the patterning sub system;

a processor; and a storage device coupled to the processor, wherein the storage device comprises instructions which, when executed by the processor, cause the processor to determine fountain solution level at the imaging surface by:

dithering the variable current drive output to the patterning subsystem to selectively remove portions of the fountain solution layer at varying current levels;

analyzing the removed portions of the fountain solution layer to acquire optical density of halftone or solid patches at the varying current levels;

identifying from the acquired optical density a maximum optical sensitivity to current variation (dL/dAmps);

identifying from the acquired optical density a minimum current value (KneeCurrent) at which a solid patch is below a threshold value;

determining fountain solution level from the maximum optical sensitivity and the minimum current value; and adjusting the layer of fountain solution based on the determined fountain solution level.

2. The system according to claim 1, wherein the acquired optical density of halftone or solid patches at the varying current levels is performed by a spectrometer or densitometer incorporated in the variable data lithography system.

3. The system according to claim 2, wherein selectively removing portions of the fountain solution is exposing the imaging surface to laser radiation from a laser imaging module.

4. The system according to claim 2, wherein dL/dAmps variation decreases as fountain solution levels decrease.

5. The system according to claim 1, wherein dL/dAmps variation increases as fountain solution levels increase.

6. The system according to claim 5, wherein KneeCurrent increases as fountain solution levels increase.

7. The system according to claim 1, wherein KneeCurrent decreases as fountain solution levels decrease.

8. An apparatus useful in a printing device, comprising:

a dither circuit coupled to a laser imaging system, said dither circuit operable to generate a variable current signal to perturb the laser imaging system to irradiate a fountain solution layer;

a spectrometer incorporated in the printing device providing a feedback signal of acquired optical density of halftone or solid patches created by the laser imaging system at each variable current signal; and a processor coupled to the dither circuit being operational to receive and process the feedback signal to adjust a layer of fountain solution based on a determined fountain solution level, wherein the processor determines the fountain solution level by identifying from the feedback signal a maximum optical sensitivity to current variation (dL/dAmps) and identifying from the feedback signal a minimum current value (KneeCurrent) at which a solid patch is below a threshold value.

9. The apparatus in accordance to claim 8, wherein the processor determines the fountain solution level by:

combining the maximum optical sensitivity and the minimum current value.

10. The apparatus in accordance to claim 9, further comprising:

at least one actuator to control fountain solution dispensing in response to the processed feedback signal.

11. A method to determine fountain solution level at an imaging surface in a variable data lithography system, the method comprising:

applying a layer of fountain solution to the imaging surface at a fountain solution flow rate;

selectively removing with a patterning subsystem portions of the fountain solution layer so as to produce a latent image thereon;

dithering a current drive output to the patterning subsystem to selectively remove portions of the fountain solution layer at varying current levels;

analyzing the removed portions of the fountain solution layer to acquire optical density of halftone or solid patches at the varying current levels;

identifying from the acquired optical density a maximum optical sensitivity to current variation (dL/dAmps);

identifying from the acquired optical density a minimum current value (KneeCurrent) at which a solid patch is below a threshold value;

determining fountain solution level from the maximum optical sensitivity and the minimum current value; and adjusting the layer of fountain solution based on the determined fountain solution level.

12. The method according to claim 11, wherein the acquired optical density of halftone or solid patches at the varying current levels is performed by a spectrometer or densitometer incorporated in the variable data lithography method.

13. The method according to claim 12, wherein dL/dAmps variation increases as fountain solution levels increase.

14. The method according to claim 11, wherein selectively removing portions of the fountain solution is exposing the imaging surface to laser radiation from a laser imaging module.

15. The method according to claim 11, wherein dL/dAmps variation decreases as fountain solution levels decrease.

16. The method according to claim 15, wherein KneeCurrent increases as fountain solution levels increase.

17. The method according to claim 11, wherein KneeCurrent decreases as fountain solution levels decrease.

18. The method according to claim 11, further comprising:

comparing determined fountain solution level to the fountain solution flow rate.

19. The method according to claim 18, wherein the adjusting is using at least one actuator to control fountain solution dispensing in response to the comparison.

* * * * *